United States Patent [19]

Perkitny et al.

[11] Patent Number: 4,685,893

[45] Date of Patent: Aug. 11, 1987

[54] TOY DOLL OR ARTICLE WITH MANIPULATIVE APPENDAGE

[75] Inventors: Jerzy Perkitny, Cleveland Heights; Edward G. Chanter, Lakewood, both of Ohio

[73] Assignee: Those Characters From Cleveland, Inc., Cleveland, Ohio

[21] Appl. No.: 866,696

[22] Filed: May 27, 1986

[51] Int. Cl.[4] ..... A63H 3/44

[52] U.S. Cl. ..... 446/319; 446/320; 132/7; 132/53

[58] Field of Search ..... 446/319, 320, 330, 337, 446/340, 372, 394, 489, 490; 132/53, 7

[56] References Cited

U.S. PATENT DOCUMENTS

| | | | |
|---|---|---|---|
| 209,413 | 10/1878 | Moses | 2/269 |
| 222,262 | 12/1879 | Felt | 2/269 |
| 297,526 | 4/1884 | Lorsch | 2/270 |
| 1,601,983 | 10/1926 | Savage | 446/362 |
| 1,619,446 | 3/1927 | Thomsen | 446/361 |
| 1,637,605 | 8/1927 | Clemence | 132/7 |
| 1,725,919 | 8/1929 | Ivey | 446/362 |
| 2,155,665 | 4/1939 | Leeper | 446/327 |
| 2,280,467 | 4/1942 | Blanc | 2/162 |
| 2,449,248 | 9/1948 | Petschauer | 446/394 |
| 2,581,366 | 1/1952 | De Grazia | 2/203 |
| 2,692,988 | 11/1954 | Rouse | 2/73 |
| 2,733,545 | 2/1956 | Guadagna | 446/330 |
| 2,846,686 | 8/1958 | Tames | 2/114 |
| 2,853,831 | 9/1958 | Bischoff | 446/488 |
| 3,698,134 | 10/1972 | Amici et al. | 446/319 |
| 3,797,166 | 3/1974 | Murray | 446/320 |
| 3,808,736 | 5/1974 | Terzian et al. | 446/296 |
| 3,828,467 | 8/1974 | Kaelin | 446/320 |
| 3,955,587 | 5/1976 | Dunn et al. | 132/53 |
| 4,070,790 | 1/1978 | Strongin et al. | 446/394 |
| 4,329,382 | 5/1982 | Truskolaski et al. | 428/4 |
| 4,393,728 | 7/1983 | Larson et al. | 446/320 X |

*Primary Examiner*—Robert A. Hafer
*Assistant Examiner*—Terrence L. B. Brown
*Attorney, Agent, or Firm*—Renner, Otto, Boisselle & Lyon

[57] ABSTRACT

A toy doll or article comprising a main body, a variable length appendage having a root end attached to the main body and an outer free end, at least one flexible elongate element threaded through the appendage along the length thereof and having a root end attached to the main body and an outer free end, the appendage outwardly of the root end thereof being slidable along the elongate element and sufficiently flexible to ruffle and unruffle when slid inwardly and outwardly along the elongate element to vary the length of the appendage. In a toy doll, the appendage includes a plurality of hair-like strands which are bundled together as by braiding or by bands encircling the strands at selected locations spaced along the length of the bundle. The strands at the free end of the bundle are held by a holding band preferably in relatively tight engagement with the elongate element frictionally to hold the free end of the bundle against movement along the elongate element which may be a length of ribbon. Two elongate elements may be employed to provide easy and quick shortening of the appendage by progressively pulling apart their free ends to apply a force to the holding band overcoming the frictional resistance provided thereby and causing the free end of the appendage to be progressively moved inwardly along the elongate elements.

30 Claims, 17 Drawing Figures

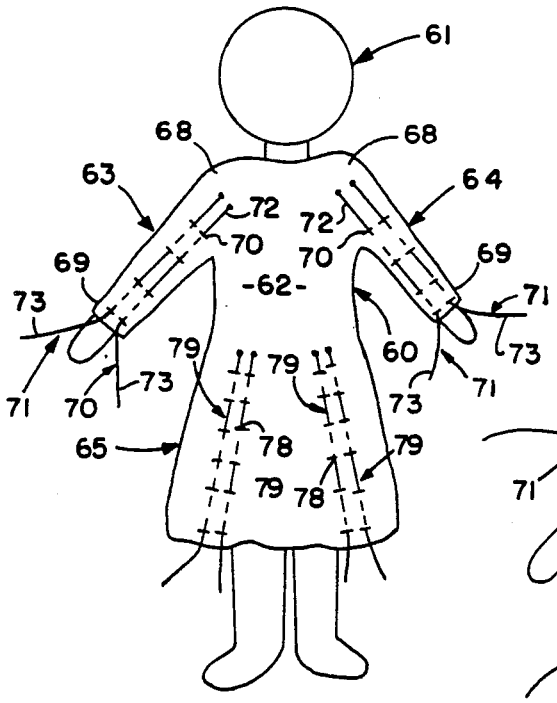
FIG. 13
FIG. 14
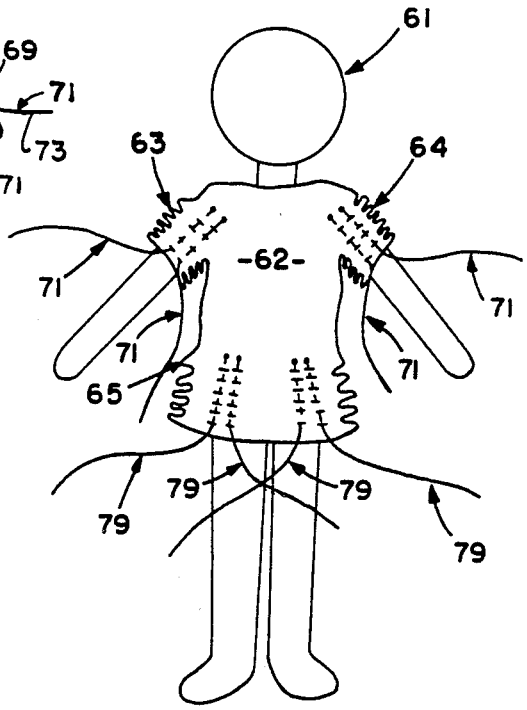
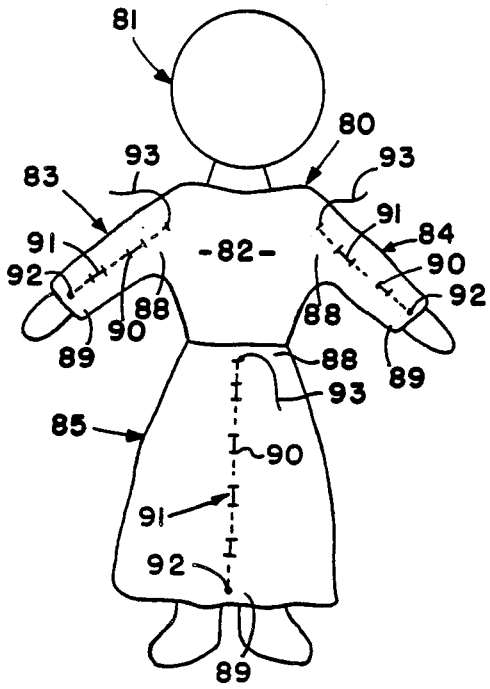
FIG. 15
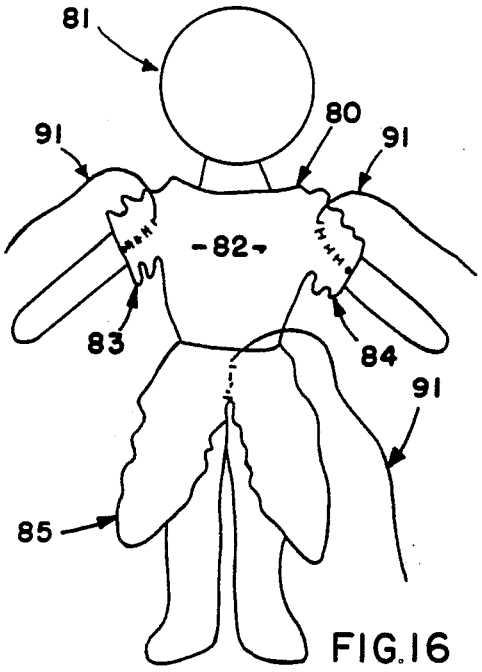
FIG. 16

TOY DOLL OR ARTICLE WITH MANIPULATIVE APPENDAGE

This invention herein disclosed relates primarily to toys and, more particularly, to toy dolls, toy animals and other toy objects which have appendages such as locks of hair, tails, ears or the like that desirably may be manipulated to vary their length and appearance in an interesting yet easy manner.

BACKGROUND

Toy dolls heretofore have been provided with hair that may be varied in length and style. In some dolls, this is accomplished by using interchangeable hair pieces, one example of this being shown in U.S. Pat. No. 4,070,790. In other dolls, the length of a doll's hair may be varied by drawing a lock of hair into and out of the doll's head, one example of this being shown in U.S. Pat. No. 3,698,134. Notwithstanding the foregoing and other known devices for varying the length and appearance of the hair of a doll, the toy art beckons for still other novel means for varying the length and appearance of not only the hair of a doll but also other appendages of toys such as the tail or ears of a toy animal.

SUMMARY OF THE INVENTION

The present invention provides a toy having an appendage that may be manipulated to vary its length and appearance in a novel, interesting and easy manner. Briefly, a toy according to the invention comprises a toy body, a variable length appendage having a root end attached to the toy body and an outer free end, at least one flexible elongate element threaded through the appendage along the length thereof and having a root end attached to the toy body and an outer free end, the appendage outwardly of the root end thereof being slidable along the elongate element and sufficiently flexible to ruffle and unruffle when slid inwardly and outwardly along the elongate element to vary the length and outer geometry of the appendage, and holding means at the free end of the appendage cooperating with the elongate element to hold the free end of the appendage against movement along the elongate element when the appendage is not being slid, whereby the length and appearance of the appendage will be maintained after being varied by sliding of the appendage along the elongate element.

Further in accordance with the invention, two such elongate elements are employed to provide easy and quick shortening of the appendage in an interesting manner. The free ends of the elongate elements extend beyond the holding means which may be a ring or band that holds the free end of the appendage in relatively tight engagement with the elongate elements to provide frictional resistance to movement of such free end. To shorten the appendage, the free ends of the elongate elements may be grasped longitudinally outwardly of the holding band and pulled apart to apply a force to the holding band overcoming the frictional resistance provided thereby and causing the free end of the appendage to be progressively moved inwardly along the elongate elements. As the free end of the appendage is thereby forced inwardly, the appendage intermediate its ends ruffles laterally outwardly to change the appearance and character of the appendage.

As will be seen, the appendage may include a bundle of strands of yarn or the like which form the hair of a doll or tail of an animal, for example. The bundle of strands has a root end attached to the toy body and from which the remainder of the bundle may dangle. Each elongate element may be a length of ribbon or the like having a root end attached to the toy body and from which the remainder of the ribbon coextends with the dangling bundle of strands and preferably beyond the free end of the bundle. The strands intermediate the ends of the bundle are held adjacent the ribbons preferably in surrounding and concealing disposition as by being braided around the ribbons or by being clipped by bands encircling the strands at selected locations spaced along the length of the bundle. The strands at the free end of the bundle are held by another or holding band preferably in sufficiently tight engagement with the ribbons frictionally to hold the free end of the bundle against movement along the ribbons.

According to another aspect of the invention, a fundamental concept underlying the invention may be applied in other applications such as in dolls' clothing or other clothing to permit variance of the length and ornamental characteristic of an appendage-like portion of such clothing or even other articles. In the context of a doll's clothing, such clothing includes a main garment portion and a second garment portion of variable length having one end attached to the main garment portion and a relatively movable or free end. The second garment portion has threaded therethrough along its length an elongate element having one end attached to the main garment portion or an adjacent end of the second garment portion and an opposite, relatively free end available for grasping. The second garment portion outwardly of its end attached to the main garment portion is slidably disposed with respect to the elongate element and sufficiently flexible to ruffle and unruffle as it is moved along the length of the elongate element to vary the length of the second garment portion. Means to maintain the varied length of the second garment portion may also be provided. As will be seen, the main garment portion, for example, may be the bodice of a doll's dress and the second garment portion a variable length sleeve or skirt portion through which the elongate element in the form of a ribbon or the like is threaded through slots at selected locations spaced along the length of the sleeve or skirt portion.

The foregoing and other features of the invention are hereinafter fully described and particularly pointed out in the claims, the following description and the annexed drawings setting forth in detail certain illustrative embodiments of the invention, these being indicative, however, of but a few of the various ways in which the principles of the invention may be employed.

BRIEF DESCRIPTION OF THE DRAWINGS

In the annexed drawings:

FIG. 13 is a front view of a dress worn by a doll showing a further application of the invention;

FIG. 14 is a front plan view similar to FIG. 13 but showing the appendages of the dress in their shortened states;

FIG. 15 is a front plan view of a modified form of doll's dress; and

FIG. 16 is a view similar to FIG. 15 but showing the appendages of the dress in their shortened states.

DETAILED DESCRIPTION

Figure 2:
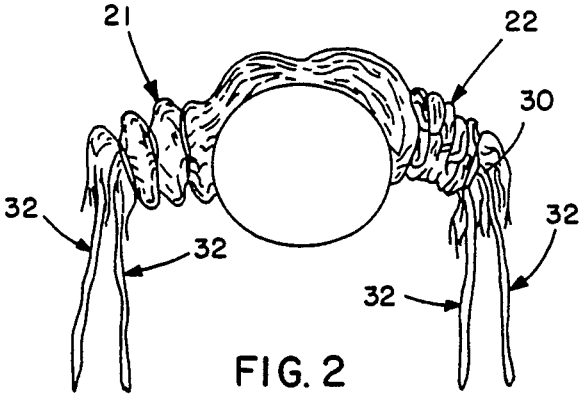
FIG. 2 is a front view similar to FIG. 1 but showing the appendages in a shortened state.
Figure 1:
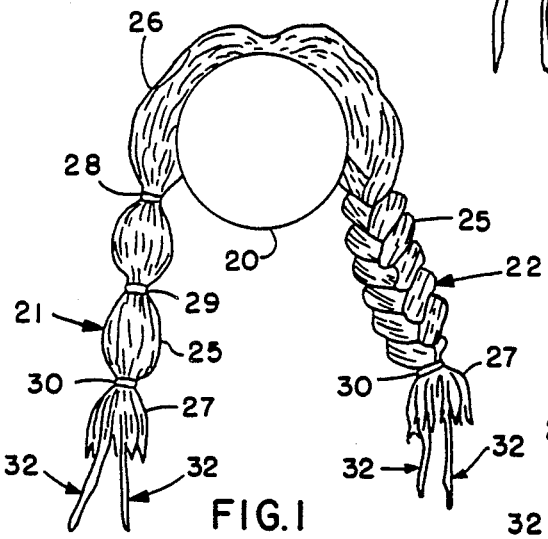
FIG. 1 is a front view of the head of a toy doll having two appendages according to the invention and which are shown in a lengthened state.

Referring now in detail to the drawings and initially to FIGS. 1 and 2, the head 20 of a doll can be seen to have two appendages 21 and 22 according to the invention. As shown, the appendages 21 and 22 may be in the form of pigtails. The pigtails normally would be of the same style and preferably identical, but two different styles of pigtails are shown to illustrate different exemplary modes in which the invention may be practiced.

The pigtail 21 at the left in FIGS. 1 and 2 includes generally parallel and coextending strands 25 of yarn or the like which form the hair of the doll. The pigtail 21 has a root end 26 at which the inner ends of the strands 25 are attached by any suitable means to the head 20 of the doll. The strands at their outer ends preferably are generally coterminous at a dangling free end 27 of the pigtail 21. The strands also are held in bundled relationship by clips or bands 28–30 which encircle the strands at selected locations spaced along the length of the pigtail. As seen in FIG. 1, the bundle of strands has a fullness which is taken in by the bands 28–30 to give the pigtail a wavy appearance. The billowing out of the strand bundle between the bands, inwardly of the innermost band 28 and outwardly of the outermost band 30 also serves to prevent shifting of the bands along the length of the pigtail, although other means may be employed to hold the bands in place with respect to the length of the bundle. As will be appreciated, the length of the pigtail and the number of bands employed may be selected as desired.

As seen in FIGS. 1–4, a pair of flexible elongate elements 32 are threaded through the pigtail 21 along the length thereof and, more particularly, through the bands 28–30. Each elongate element may be a length of ribbon, string or the like having a root end 33 attached by suitable means to the head 20 of the doll and an outer free end 34 preferably extending beyond the free end 27 of the pigtail by an amount sufficient to permit easy grasping of such projecting free end 34. At each band, the strands 25 are held adjacent the ribbons 32 and, as is preferred, the strands surround and thereby conceal the ribbons over the portion thereof coextensive with the strands.

Figure 3A:
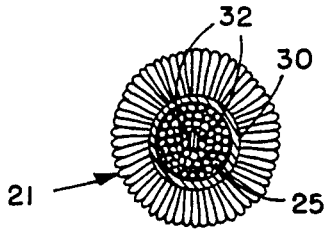
FIG. 3A is an enlarged transverse sectional view through an appendage taken substantially along the line 3A—3A of FIG. 3.

The outermost band 30 at the free end 27 of the pigtail 21, such band 30 herein being referred to as a holding band, holds the strands 25 in sufficiently tight frictional engagement with the ribbons 32, as illustrated in FIG. 3A, to provide frictional resistance to movement of the free end 27 of the pigtail along the length of the ribbons. The other bands 28 and 29 may less tightly hold the strands to the ribbon to permit at such band locations relatively free sliding movement of the strands along the ribbons, but, in the preferred embodiment, the frictional engagement afforded by bands 28–30 should be essentially the same. As a further option, the bands may afford different respective levels of frictional resistance.

Figure 3:
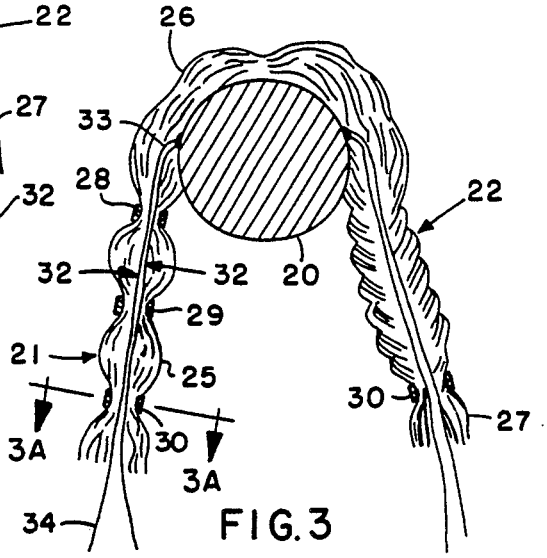
FIG. 3 is a longitudinal sectional view through the doll in its FIG. 1 state.
Figure 4:
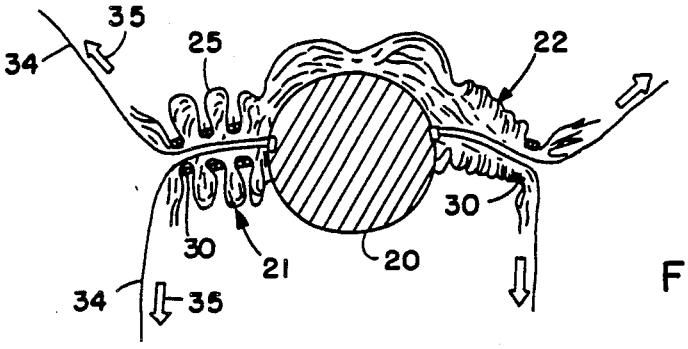
FIG. 4 is a longitudinal sectional view through the doll in its FIG. 2 state.

As can be seen by comparing FIG. 1 with FIG. 2 and FIG. 3 with FIG. 4, the dangling portion of the pigtail 21 can be slid along the length of the ribbons 32 to vary the apparent length of the pigtail. In connection therewith, the strands 25 of the pigtail are sufficiently flexible to ruffle and unruffle at portions thereof intermediate the bands 28–30 as the pigtail is shortened or lengthened, respectively. That is, the strands at such portions thereof billow laterally outwardly as the free end of the pigtail is moved inwardly along the ribbons towards the head of the doll and collapse laterally inwardly as the free end of the pigtail is moved away from the head of the doll along the ribbons. Accordingly, the pigtail may be manipulated to vary the length thereof. Also, the ruffling and unruffling of the pigtail gives rise to a substantial change in the appearance or character of the pigtail between the lengthened and shortened states of the pigtail as by changing the outer geometry thereof.

As will be appreciated, the pigtail 21 can be shortened in an easy and interesting manner by grasping the accessible free ends 34 of the ribbons 32 and pulling them laterally apart. As the ribbons are thusly and progressively pulled apart, the separating portions thereof outwardly of the holding band 30 will exert a force on the holding band which overcomes the frictional holding force thereof and causes the holding band to move progressively inwardly towards the head 20 of the doll. If desired, the ribbons may be rapidly pulled apart as indicated by the arrows 35 in FIG. 4 to effect sudden shortening of the pigtail 21 to its fully shortened condition illustrated in FIG. 4. When the ribbons are no longer being pulled apart, or have been released, the exposed outer end portions thereof may simply be left dangling while the frictional holding force of the holding band serves to hold the free end of the pigtail against outward movement along the ribbons thereby to maintain the new varied length of the pigtail. When one thereafter desires to increase the length of the pigtail, the free end of the pigtail may be grasped and pulled outwardly away from the head of the doll along the length of the ribbons preferably while the ribbons are held taut and together at their free ends 34.

Referring now to the other pigtail at the right in FIGS. 1–4, such pigtail 22 is generally similar to the pigtail 21 except that the strands 25 thereof are braided around the ribbons 32 and only one band, the holding band 30, is employed. The strands 25 may be conventionally braided as by dividing the same into three subbundles which may then be braided around the ribbons. The holding band 30, in addition to performing the same function as the holding band of pigtail 21, also may serve to prevent unraveling of the braided strands.

Being braided around the ribbons 32, the strands 25 of pigtail 22 are held adjacent and preferably conceal the ribbons extending through the core of the braided pigtail. Preferably, the strands are loosely braided to permit a substantial change in the apparent length and character of the pigtail. If too tightly braided, the resultant stiffness of the pigtail would limit the degree of length adjustment. Also, the loosely braided strands will be relatively free to ruffle or expand laterally outwardly as the free end 27 of pigtail 22 is moved inwardly towards the head 20 of the doll along the ribbons as seen in FIGS. 2 and 4. As will also be appreciated, the pigtail 22 may be manipulated in the same manner as the pigtail 21.

Figure 5:
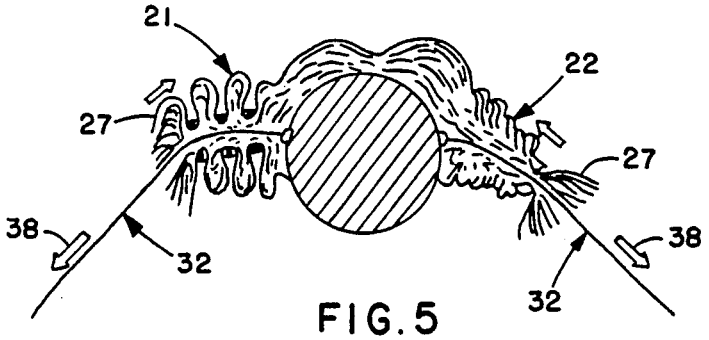
FIG. 5 is a longitudinal sectional view through a modified form of the doll shown in FIG. 1.

Turning now to FIG. 5, the therein illustrated toy is identical to the above described toy except that each pigtail 21 and 22 has associated therewith only one elongate element 32. Consequently, there is no second elongate element which can be pulled apart from the illustrated elongate element to effect shortening of the respective pigtail in the aforedescribed manner. However, each pigtail may otherwise be shortened in length as by grasping and advancing the free end 27 of the pigtail inwardly towards head 20 of the doll along the elongate element 32. As is preferred, the elongate element 32 may be held in a tensioned state as indicated by the arrow 38 to facilitate sliding movement of the pigtail therealong.

Figure 6:
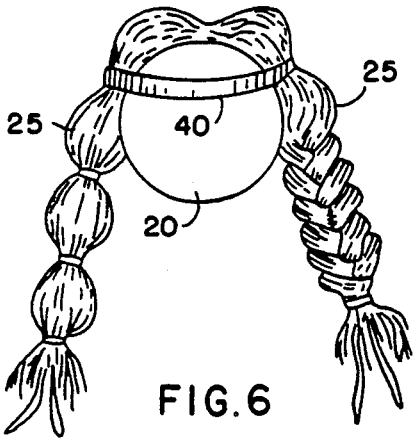
FIG. 6 is a front view of another toy doll embodiment of the invention.
Figure 7:
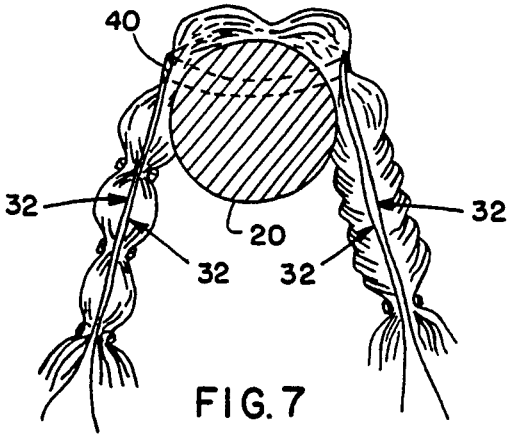
FIG. 7 is a sectional view through the toy doll of FIG. 6 with the appendages thereof shown in their lengthened states.
Figure 8:
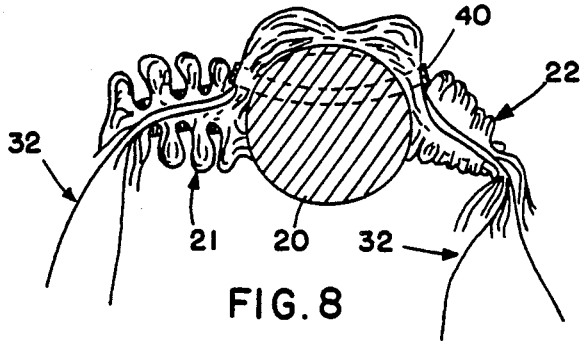
FIG. 8 is a sectional view through the toy doll of FIG. 6 showing the appendages thereof in their shortened states.
Figure 9:
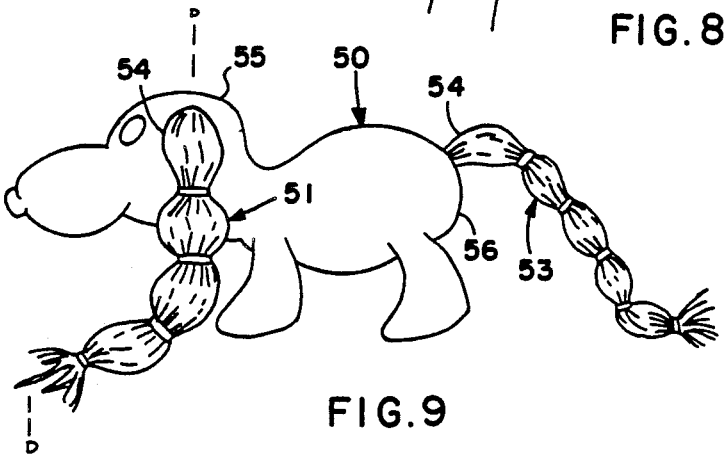
FIG. 9 is a side view of a toy animal having appendages forming the ears and tail thereof in accordance with the invention.
Figure 10:
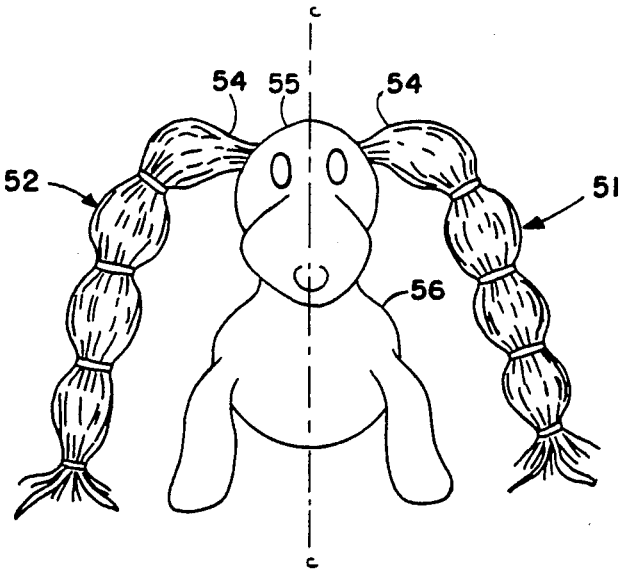
FIG. 10 is a front view of the toy animal of FIG. 9.
Figure 11:
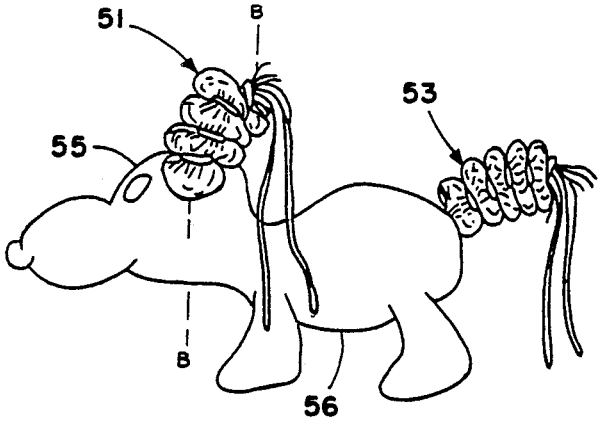
FIG. 11 is a side view similar to FIG. 10 but showing the appendages in their shortened states.
Figure 12:
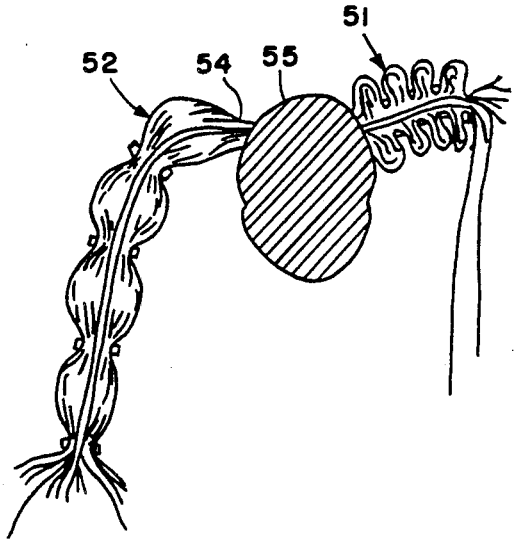
FIG. 12 is a sectional view through the toy animal with one of the appendages in a lengthened state and another one of the appendages in a shortened state.

Still another adaptation of the above described toy can be seen in FIGS. 6–8. In this adaptation, the elongate elements 32 are attached to the head 20 of the doll by a headband 40. The inner end of the elongate elements are attached directly to the headband which circumscribes the root ends of the pigtails and the head of the doll. From their points of connection to the headband, the elongate elements are passed into the interior of the gathered or braided strands 25 of the respective pigtail. Except for this change, the adaptation of FIGS. 6–8 may be otherwise identical to the toy shown in FIGS. 1–4. Such adaptation also may be modified by using only a single elongate element, such modification having been discussed above with reference to FIG. 5.

FIGS. 9–12 illustrate an application of the invention to a toy animal such as a toy dog. The toy dog 50 has three appendages 51–53 which, as shown, may each be similar to the appendage 21 of FIGS. 1–4. Appendages 51 and 52 are attached at their root ends 54 to the head 55 of the dog to form the dog's ears whereas the third appendage 53 is attached at its root end 54 to the rear end of the dog's body 56 to form the dog's tail.

Still another application of the fundamental concept underlying the present invention is illustrated in FIGS. 13 and 14. As shown, the invention may be practiced in dolls' clothing and, as will be appreciated, other types of clothing or other articles as well. In FIG. 13, the dress 60 worn on the doll 61 has a main body or garment portion 62 and secondary garment portions or appendages 63–65. The main garment portion 62 forms the bodice of the dress, the secondary garment portions 63 and 64 form the sleeves of the dress, and the secondary garment portion 65 forms the skirt portion of the dress.

Each sleeve 63, 64 of the dress 60 has what may be considered a root end 68 attached to the shoulder of the bodice 62 and a free end 69. Threaded through slots or openings 70 spaced along the length of the sleeve are two flexible elongate elements 71 which alternately pass inside and outside the material of the sleeve going from slot to slot. As shown, there are two parallel rows of slots 70 extending along the length of the sleeve, one row of slots for each elongate element. Each elongate element may be in the form of a length of ribbon, string or the like having a root end 72 attached by suitable means to the shoulder of the bodice 62 and an outer free end 73 preferably extending beyond the free end 69 of the sleeve 63. The slots may be reinforced in conventional manner as like buttonholes or with eyelets.

As can be seen by comparing FIG. 13 with FIG. 14, the portion of each sleeve 63, 64 outwardly of its root end 68 can be slid along the length of the respective ribbons 71 to vary the apparent length of the sleeve. In connection therewith, the sleeve being made of flexible fabric material will ruffle and unruffle at portions thereof intermediate the slots as the sleeve is shortened or lengthened, respectively. Accordingly, the sleeve may be manipulated to vary its length while the ruffling and unruffling thereof gives rise to a substantial change in the appearance or ornamental characteristic of the sleeve between its lengthened and shortened states.

As will be appreciated, each sleeve 63, 64 can be shortened by grasping the accessible free ends 73 of the respective ribbons 71 and pulling them laterally apart. As the ribbons are thusly and progressively pulled apart, the separating portions thereof will cause the free end of the sleeve to move progressively inwardly towards the shoulder of the bodice 62. If desired, each ribbon and at least the outermost slot through which it is threaded may be relatively sized and configured to provide a frictional holding force to maintain the new varied length of the sleeve. Alternatively, the free ends of the ribbons may be simply tied together as in a bow to maintain a desired shortened length of the sleeve.

In FIGS. 13 and 14, it can be seen that the skirt portion 65 of the dress may be provided with a similar arrangement of slots 78 and ribbons 79 extending along the length thereof as at two different locations. Accordingly, the length and appearance of the skirt portion can be varied in a manner similar to that above described with respect to the sleeves 63 and 64.

Turning now to FIGS. 15 and 16, another application of a fundamental concept of the invention to dolls' clothing is illustrated. Like the FIGS. 13 and 14 embodiment, the dress 80 worn on the doll 81 has a main body or garment portion 82 and secondary garment portions or appendages 83–85. The main garment portion 82 forms the bodice of the dress, the secondary garment portions 83 and 84 form the sleeves of the dress and the secondary garment portion 85 forms the skirt portion of the dress.

Each secondary garment portion 83, 84, 85 has what may be considered a root end 88 attached to the main garment portion 82 and a free end 89. Each secondary garment portion has a row of slots or openings 90 spaced along the length thereof and through which a flexible elongate element 91 is threaded. Each elongate element may be in the form of a length of ribbon, string, or the like having an outer end 92 attached by suitable means to the adjacent free end 89 of the secondary garment portion and an inner end 93 extending beyond the root end 88 of the secondary garment portion.

As will be appreciated, each secondary garment portion 83, 84, 85 can be shortened by grasping and pulling the accessible inner end 93 of the respective ribbon thereby to slidably draw the ribbon through the slots 90 and pull the free end of the secondary garment portion inwardly towards the main garment portion. In connection therewith, the secondary garment portion being of flexible fabric material will be caused to ruffle at portions thereof intermediate the slots. Accordingly, the secondary garment portion may be manipulated to vary the length thereof while the ruffling of the secondary garment portion gives rise to a substantial change in the appearance or ornamental character of the secondary garment portion in relation to its lengthened state. On the other hand, the secondary garment portion may be returned to its lengthened state by pulling the free end thereof outwardly.

Although the invention has been shown and described with respect to various embodiments thereof, it is obvious that equivalent alterations and modifications will occur to others skilled in the art upon the reading and understanding of this specification. The present invention includes all such equivalent alterations and modifications, and is limited only by the scope of the following claims.

What is claimed is:

1. A toy comprising a toy body, a flexible appendage having a root end attached to said toy body and a free end remote from said toy body, said appendage being selectively movable from and between a compressed, ruffled condition and an extended, unruffled condition, means enabling such movement of said appendage comprising a flexible elongate element threaded longitudinally through said appendage, said appendage being slidable relative to said elongate element, means for retaining said flexible appendage selectively at and intermediate said compressed and extended conditions, said retaining means comprising holding means frictionally coacting with said elongate element for restraining a selected portion of said appendage against sliding movement relative to said elongate element, said holding means being slidable relative to said elongate element upon enduring force sufficient to overcome the frictional coaction between said holding means and said elongate element, said elongate element comprising a length of material having a string-like flexibility.

2. A toy as set forth in claim 1, wherein said appendage includes a plurality of hair-like strands.

3. A toy as set forth in claim 2, including band means encircling said strands and elongate element at said free end of said appendage, and wherein said elongate element includes two lengths of material having string-like flexibility threaded longitudinally through said appendage and each length of material having a root end attached to said toy body and a free end encircled by said band means, said lengths of material being accessible at their free ends for grasping and pulling laterally apart to apply to said band means a force operative to push said free end of said appendage along said lengths of material.

4. A toy as set forth in claim 3, wherein said strands are bundled around said lengths of material to conceal said lengths of material at a portion thereof coextensive with said strands.

5. A toy as set forth in claim 2, including plural clip means for laterally holding said strands to said elongate element at respective attachment locations spaced apart along the length of said appendage, whereby when said appendage is moved from said extended condition to said compressed condition, said attachment locations move towards each other while portions of said strands between said attachment locations pucker laterally outwardly to form ruffles.

6. A toy as set forth in claim 5, wherein said plural clip means include plural band means encircling said strands to hold said strands at said attachment locations adjacent said elongate element.

7. A toy as set forth in claim 6, wherein said toy body includes the head of a doll and said strands form the hair of said doll.

8. A toy as set forth in claim 7, wherein said strands are bundled together to form a pigtail.

9. A toy as set forth in claim 6, wherein said elongate element includes a length of ribbon.

10. A toy as set forth in claim 5, wherein said holding means includes at least one of said plural clip means operative at a respective one of said attachment locations to effect frictional engagement between said strands and elongate element thereby to afford at said respective one of said attachment locations frictional resistance to sliding movement of said appendage relative to said elongate element.

11. A toy as set forth in claim 10, wherein said one of said plural clip means includes band means encircling said strands and elongate element to maintain said strands bundled around and frictionally engaged against said elongate element.

12. A toy as set forth in claim 2, wherein said holding means includes plural clip means for holding said strands at respective attachment locations to said elongate element and in frictional engagement with said elongate element thereby to afford at said attachment locations frictional resistance to sliding movement of said appendage relative to said elongate element.

13. A toy as set forth in claim 12, wherein at least a plurality of said plural clip means each includes band means encircling said strands and elongate element to maintain said strands bundled around and frictionally engaged against said elongate element.

14. A toy as set forth in claim 12, wherein said attachment locations are spaced apart along the length of said appendage, whereby when said appendage is moved from said extended condition to said compressed condition, said attachment locations move towards each other while portions of said strands between said attachment locations pucker laterally outwardly to form ruffles.

15. A toy as set forth in claim 12, wherein the frictional resistances afforded by said plural clip means are substantially the same.

16. A toy as set forth in claim 12, wherein said toy body includes the head of a doll and said strands form the hair of said doll.

17. A toy as set forth in claim 2, wherein said elongate element includes two lengths of material having a string-like flexibility threaded longitudinally through said appendage, each length of material having one end secured with respect to one end of said appendage and a relatively free end extending from the opposite end of said appendage, and band means secured with respect to said opposite end of said appendage and encircling said lengths of material, said lengths of material being accessible at their free ends for grasping and pulling laterally apart at said band means to effect sliding relative movement between said lengths of material and said appendage.

18. A toy as set forth in claim 2, wherein said strands are bundled around said elongate element.

19. A toy as set forth in claim 18, wherein said strands are braided around said elongate element.

20. A toy as set forth in claim 2, wherein said toy body includes the head of a doll and said strands form the hair of said doll.

21. A toy as set forth in claim 20, including a headband encircling said head of the doll and said root end of said appendage, and wherein said elongate element has one end attached to said headband.

22. A toy as set forth in claim 2, wherein said strands constitute one of a group consisting of the hair of a doll, a tail of a toy animal, and an ear of a toy animal.

23. A toy as set forth in claim 1, wherein said appendage constitutes one of a group consisting of the hair of a doll, a tail of a toy animal and an ear of a toy animal.

24. A toy as set forth in claim 2, wherein said holding means includes at least one clip means for holding said strands at a location along the appendage in frictional engagement with said elongate element thereby to afford at said location frictional resistance to sliding movement of said appendage relative to said elongate element.

25. A toy as set forth in claim 24, wherein said one clip means is attached to said appendage at its free end.

26. A toy as set forth in claim 25, wherein said one clip means effects frictional engagement between said strands and elongate element sufficient to hold said free end of said appendage against sliding movement relative to said elongate element.

27. A toy as set forth in claim 26, wherein said one clip means includes band means encircling said strands and elongate element to maintain said strands frictionally engaged with said elongate element.

28. A toy as set forth in claim 25, wherein said elongate element includes two lengths of material having a string-like flexibility threaded longitudinally through said appendage, each length of material having a root end attached to said toy body and a free end laterally contained by said one clip means, said lengths of material being accessible at their free ends for grasping and pulling laterally apart to apply to said one clip means a force operative to push said free end of said appendage along said lengths of material.

29. A toy as set forth in claim 1, wherein said holding means includes means at said free end of said appendage for restraining said free end of said appendage against sliding movement relative to said elongate element.

30. A toy as set forth in claim 1, wherein said elongate element includes two lengths of material having a string-like flexibility threaded longitudinally through said appendage, each length of material having one end secured with respect to one end of said appendage and a relatively free end extending from the opposite end of said appendage, and means coacting with said appendage and lengths of material for causing said appendage to move from said extended condition to said compressed condition under a force exerted by said lengths of material when laterally pulled apart at their free ends.

* * * * *